US011788405B2

(12) United States Patent
Tian et al.

(10) Patent No.: US 11,788,405 B2
(45) Date of Patent: Oct. 17, 2023

(54) DOWNHOLE OIL LEVEL DETECTION DEVICE

(71) Applicant: China Oilfield Services Limited, Tianjin (CN)

(72) Inventors: Zhibin Tian, Hebei (CN); Zanqing Wei, Hebei (CN); Lin Huang, Hebei (CN); Xiaoqiang Du, Hebei (CN); Yongren Feng, Hebei (CN); Bin Gao, Hebei (CN); Peng Sun, Hebei (CN); Yong Jiang, Hebei (CN); Minglue Fan, Hebei (CN); Shiwei Zong, Hebei (CN)

(73) Assignee: China Oilfield Services Limited, Tianjin (CN)

( * ) Notice: Subject to any disclaimer, the term of this patent is extended or adjusted under 35 U.S.C. 154(b) by 202 days.

(21) Appl. No.: 17/440,143

(22) PCT Filed: Feb. 14, 2020

(86) PCT No.: PCT/CN2020/075289

§ 371 (c)(1),
(2) Date: Sep. 16, 2021

(87) PCT Pub. No.: WO2021/056951

PCT Pub. Date: Apr. 1, 2021

(65) Prior Publication Data

US 2022/0154573 A1 May 19, 2022

(30) Foreign Application Priority Data

Sep. 23, 2019 (CN) ..... 201910901478.4

(51) Int. Cl.
*E21B 47/047* (2012.01)
*E21B 33/12* (2006.01)

(52) U.S. Cl.
CPC ..... *E21B 47/047* (2020.05); *E21B 33/12* (2013.01)

(58) Field of Classification Search
CPC .... E21B 47/047; E21B 33/12; E21B 23/0412; E21B 47/00
See application file for complete search history.

(56) References Cited

U.S. PATENT DOCUMENTS 5,086,645 A 2/1992 Deaton
2002/0029908 A1* 3/2002 Bloom ..... E21B 4/18 166/212
2014/0158228 A1 6/2014 Tao

FOREIGN PATENT DOCUMENTS

CN 1544800 A 11/2004
CN 201367897 Y 12/2009
(Continued)

OTHER PUBLICATIONS

Written Opinion in English for PCTPCT/CN2020/075289, dated 2020.*
(Continued)

*Primary Examiner* — Steven A MacDonald
(74) *Attorney, Agent, or Firm* — Banner & Witcoff, Ltd.

(57) ABSTRACT

A downhole oil level detection device includes a mounting housing (1) and a balance cylinder (2) installed on the mounting housing (1). The balance cylinder (2) includes a cylinder body (25) and a moving piston (21), a piston tension spring (22), a moving rod (23), a moving rod compression spring (24) and a displacement sensor (3) installed in the cylinder body (25). One end of the piston tension spring (22) is fixed to one end of the cylinder body (25), the other end thereof is connected to one side of the moving piston (21); one side of the moving piston (21) is also connected to one end of the moving rod compression spring (24), the other end of the moving rod compression spring (24) is connected to one end of the moving rod (23), the other end of the moving rod (23) is provided with the displacement sensor (3).

16 Claims, 5 Drawing Sheets

(56) References Cited

FOREIGN PATENT DOCUMENTS

| | | | |
|---|---|---|---|
| CN | 201546697 | U | 8/2010 |
| CN | 201635719 | U | 11/2010 |
| CN | 201635730 | U | 11/2010 |
| CN | 202141427 | U | 2/2012 |
| CN | 202633165 | U | 12/2012 |
| CN | 103225503 | A | 7/2013 |
| CN | 103758514 | A | 4/2014 |
| CN | 103940731 | A | 7/2014 |
| CN | 105134095 | A | 12/2015 |
| CN | 103758514 | B | 5/2016 |
| CN | 206231597 | U | 6/2017 |
| CN | 109184673 | A | 1/2019 |
| CN | 110230490 | A | 9/2019 |
| CN | 110566183 | A | 12/2019 |
| RU | 2325518 | C2 | 5/2008 |
| RU | 2559979 | C1 | 8/2015 |
| RU | 176900 | U1 | 2/2018 |
| WO | 2012149375 | A2 | 11/2012 |

OTHER PUBLICATIONS

May 14, 2020—International Search Report and Written Opinion of PCT/CN2020/075289.
Jun. 1, 2020—(CN) First Office Action—App 201910901478.4.

* cited by examiner

DOWNHOLE OIL LEVEL DETECTION DEVICE

CROSS-REFERENCE TO RELATED APPLICATIONS

The present application is a U.S. National Phase Entry of International PCT Application No. PCT/CN2020/075289 having an international filing date of Feb. 14, 2020, which claims priority to Chinese Patent Application No. 201910901478.4 filed on Sep. 23, 2019. The present application claims priority and the benefit of the above-identified applications and the above-identified applications are incorporated by reference herein in their entirety.

TECHNICAL FIELD

Embodiments of the present application relate to but are not limited to the field of oil well survey equipment, in particular to a device for detecting a downhole oil level.

BACKGROUND

In downhole instruments such as rotary sidewall coring instrument, hydraulic oil is widely used as a working medium, and the volume of hydraulic oil used is relatively large. Under an influence of changes of temperature and environment pressure, the volume of the hydraulic oil changes greatly. In order to reduce the influence of downhole pressure and temperature on the volume change of the hydraulic oil, a balance piston is commonly used for compensation, so as to reduce the influence of environment temperature and wellbore pressure on the system.

In a process of rotary coring operation, a drill bit rotates at high speed under high-temperature and high-pressure downhole environment, the requirements for downhole mechanical rotary dynamic sealing technology are high. Due to a large pressure difference between a wellbore and a formation as well as an influence of the high temperature environment and due to complex loading on the drill bit, mechanical sealing failure frequently occurs. For the mechanical rotary dynamic sealing technology, slight leakage can reduce friction and improve mechanical efficiency, but excessive leakage will damage the instrument. For a downhole rotary coring instrument, if the hydraulic oil leaks too fast and the leakage amount is too large, the operation risk is extremely high, which may cause damage to the instrument, or even cause an accident of downhole mud invasion, which will make the instrument almost scrapped.

SUMMARY

The following is a summary of the subject matter described in detail in the present disclosure. This summary is not intended to limit the protection scope of the claims.

An embodiment of the present application discloses a device for detecting a downhole oil level, including an installation housing and a balance cylinder installed on the installation housing. The balance cylinder includes a cylinder body and a moving piston, a piston tension spring, a moving rod, a moving rod compression spring, a displacement sensor, a limiting structure and a clamping structure which are installed in the cylinder body. One end of the piston tension spring is fixed at one end of the cylinder body, and the other end of the piston tension spring is connected with a first side of the moving piston. The first side of the moving piston is further connected with one end of the moving rod compression spring. The other end of the moving rod compression spring is connected with one end of the moving rod, and the other end of the moving rod is provided with the displacement sensor. The displacement sensor is configured to measure a displacement of the moving piston. The other end of the moving rod is provided with the limiting structure. The first side of the moving piston is connected with the clamping structure. The moving piston is configured to drive the moving rod to move through a cooperation between the clamping structure, the limiting structure and the moving rod compression spring.

Other aspects will be understood after reading and understanding the brief description of drawings and the embodiments of the present application.

BRIEF DESCRIPTION OF DRAWINGS

When considered in combination with the drawings, with reference to the following description, the embodiments of the present application can be understood more completely and better, and many accompanying advantages can be easily known. However, the drawings described here are used for providing an understanding of the embodiments of the present application and constitute a part of the embodiments of the present application. The illustrative embodiments of the present application and the description thereof are used for explaining the present application, and do not constitute a limitation on the present application, in which.

DESCRIPTION OF REFERENCE SIGNS

1—installation housing, 2—balance cylinder, 21—moving piston, 22—piston tension spring, 23—moving rod, 231—annular step, 24—moving rod compression spring, 25—cylinder body, 26—fixing sleeve, 27—fixing bushing, 271—radial protrusion, 3—displacement sensor, 31—fixing end, 32—sliding end, 33—fixing rod, 4—upper fixing head, 5—lower fixing head, 6—sealing plug, 7—threaded hole, 8—oil and wire passing communication hole.

DETAILED DESCRIPTION

The drawings illustrate the embodiments of the present application.

The embodiments of the present application are described below, and examples of the embodiments are shown in the accompanying drawings, in which identical or similar reference signs throughout denote identical or similar elements or elements having identical or similar functions. The embodiments described below with reference to the drawings are exemplary, and are merely intended to explain the embodiments of the present application, but cannot be construed as limitations on the embodiments of the present application.

An embodiment of the present application discloses a device for detecting a downhole oil level, which is capable of detecting an oil level of hydraulic oil in a downhole instrument in real time, thereby avoiding serious accidents caused by excessive leakage of the hydraulic oil.

In a coring operation, a hydraulic motor is used for driving a drill bit to drill the core, which requires a lot of hydraulic oil. In a high temperature or high pressure environment, the volume of the hydraulic oil changes greatly. In order to avoid occurrence of the above-mentioned downhole failure, the applicant of the present application found through research that if a position change of a balance piston can be detected in real time, the leakage amount and leakage speed of the hydraulic oil can be accurately determined, so that the instrument can be completely prevented from being damaged and malignant events such as downhole mud invasion can be avoided.

Figure 1:
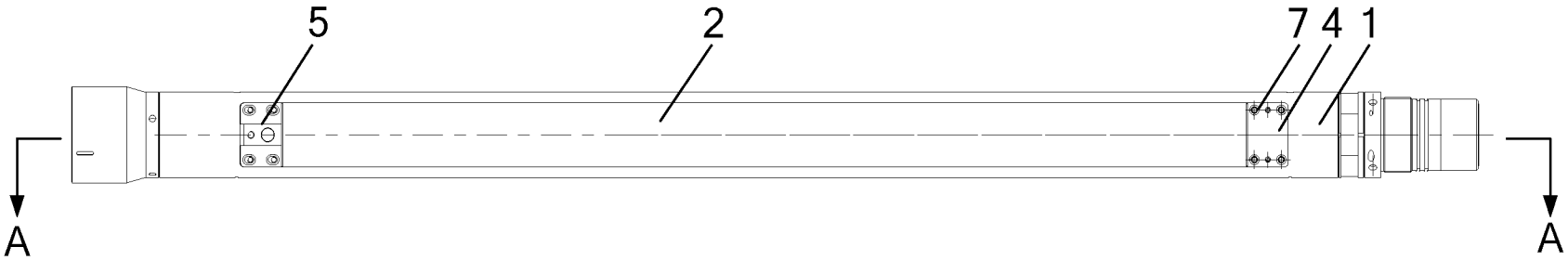
FIG. 1 is a schematic structural diagram of a device for detecting a downhole oil level according to an embodiment of the present application.
Figure 2:
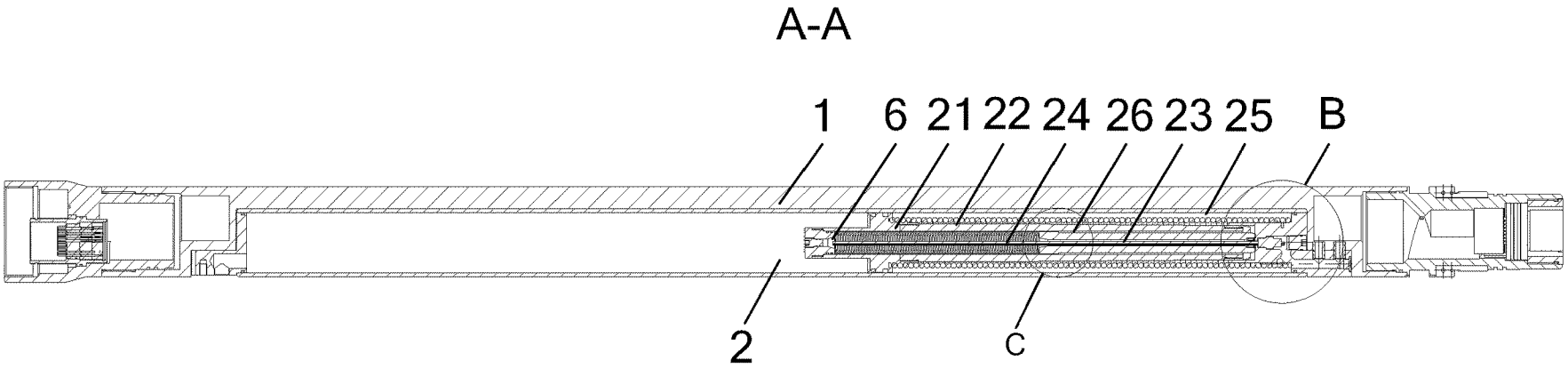
FIG. 2 is a schematic sectional view of the device for detecting a downhole oil level shown in FIG. 1 taken along A-A according to some exemplary embodiments.

An embodiment of the application discloses a device for detecting a downhole oil level. As shown in FIG. 1 and FIG. 2, the device for detecting a downhole oil level includes an installation housing 1 and a balance cylinder 2, the balance cylinder 2 is installed on the installation housing 1. The balance cylinder 2 includes a cylinder body 25, and a moving piston 21, a piston tension spring 22, a moving rod 23, a moving rod compression spring 24, a displacement sensor 3, a limiting structure and a clamping structure which are installed in the cylinder body 25. One end of the piston tension spring 22 is fixed at one end of the cylinder body 25, and the other end of the piston tension spring 22 is connected with a first side of the moving piston 21. The first side of the moving piston 21 is further connected with one end of the moving rod compression spring 24. The other end of the moving rod compression spring 24 is connected with one end of the moving rod 23. The other end of the moving rod 23 is provided with the displacement sensor 3 configured to measure a displacement of the moving piston 21. The displacement sensor 3 is configured to measure a displacement of the moving piston 21. The other end of the moving rod 23 is provided with the limiting structure. The first side of the moving piston 21 is further connected with the clamping structure. The moving piston 21 drives the moving rod 23 to move through a cooperation of the clamping structure, the limiting structure and the moving rod compression spring 24.

The device for detecting a downhole oil level disclosed by the embodiments of the present application detects the oil level of hydraulic oil in the downhole instrument by detecting the displacement of the moving piston, the downhole instrument is lifted in advance for maintenance when the oil level is abnormal, thereby avoiding serious accidents such as downhole mud invasion. In addition, the device for detecting a downhole oil level disclosed by the embodiments of the present application has a relatively simple structure, high working reliability and long service life, thus greatly improves the practicability of the device for detecting a downhole oil level.

In some exemplary embodiments, a working process of the device for detecting a downhole oil level is as follows: as shown in FIG. 2, the left side of the moving piston 21 is in communication with downhole mud, and the right side of the moving piston 21 is in communication with a hydraulic oil tank inside the downhole instrument, which is in an initial state before oil injection. When the hydraulic oil tank is fully filled with oil (i.e., the right side of the moving piston 21 is filled with hydraulic oil), the moving piston 21 moves to the left, and the piston tension spring 22 is stretched; while the inside moving rod compression spring 24, due to its initial state of being compressed, will abut against the moving rod 23 towards the right (i.e., the moving rod compression spring 24 presses against the moving rod 23, and the moving rod 23 does not move relative to the cylinder body 25). After the moving piston 21 moves to the left for a certain distance (the distance is set as S1, then a position of the moving piston is set as L1), the moving piston 21 and the moving rod 23 are connected by the limiting structure, so that the moving rod 23 and the moving piston 21 move to the left synchronously. A limit distance (end point) of the leftward movement of the moving piston 21 and the moving rod 23 is reached when the moving piston 21 abuts against a left end portion of the balance cylinder 2 (for example, against a lower fixing head 5). The distance between a position where the moving piston 21 and the moving rod 23 start to move together and a leftmost extreme position reached by the moving piston and the moving rod is set as S2, and the position of the moving piston at this time is set as L2. Since the moving rod 23 is provided with relevant components of the displacement sensor 3, the distance (i.e., S2) by which the moving rod 23 moves with the moving piston 21 can be detected, and a maximum distance by which the moving piston 21 actually moves is S1+S2. In an actual coring operation, after the internal oil tank is fully filled with oil, it is needed to continue to inject oil, so that the distance of the moving piston 21 moving to the left from the initial state is greater than S1 and less than S1+S2, so as to ensure that the hydraulic oil pressure in the instrument is greater than a formation mud pressure.

In some exemplary embodiments, a measurement range of the displacement sensor 3 may be selected to be less than S1+S2. When the volume of the hydraulic oil in the oil tank decreases, the moving piston 21 moves to the right, and the displacement sensor 3 is still capable of detecting the position of the moving piston 21. If the volume of the hydraulic oil in the oil tank continues to decrease, when the moving piston 21 moves rightward to the right of the position L1 (that is, the displacement of the moving piston 21 from a position in the initial state to the left is less than S1), the displacement sensor 3 is incapable of continuing detecting a change of the displacement of the moving piston 21 (the displacement sensor 3 is only capable of detecting S2, but incapable of detecting S1). At this time, the hydraulic oil in the hydraulic oil tank of the instrument is insufficient and cannot continue to work. It is needed to deactivate the instrument and lift it out of the wellhead to avoid serious damage to the instrument due to the occurrence of downhole mud invasion caused by mud entering the oil tank of the instrument. The moving distance S1+S2 of the moving piston 21 may exceed a maximum measurement range of the displacement sensor 3. However, in actual operation, attention should be paid to prevent the internal pressure of the hydraulic oil tank from being excessively high, which makes the moving piston move to the extreme position, which further leads to the fact that when the hydraulic oil inside the oil tank expands, the moving piston cannot continue to move and a volume increase caused by the expansion of the oil cannot be compensated, resulting in an excessively high internal pressure of the hydraulic oil tank and damage to the downhole instrument.

Figure 3:
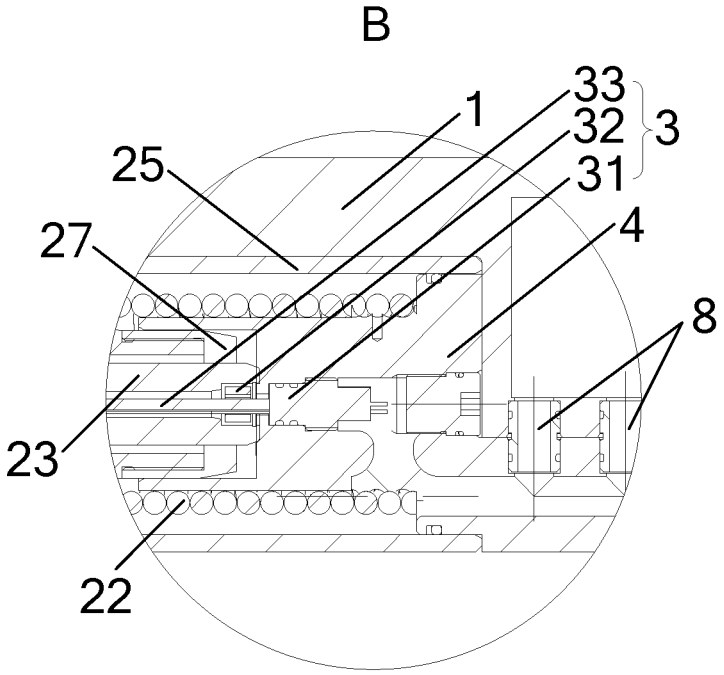
FIG. 3 is an enlarged view of a structure of portion B shown in FIG. 2 according to some exemplary embodiments.
Figure 4:
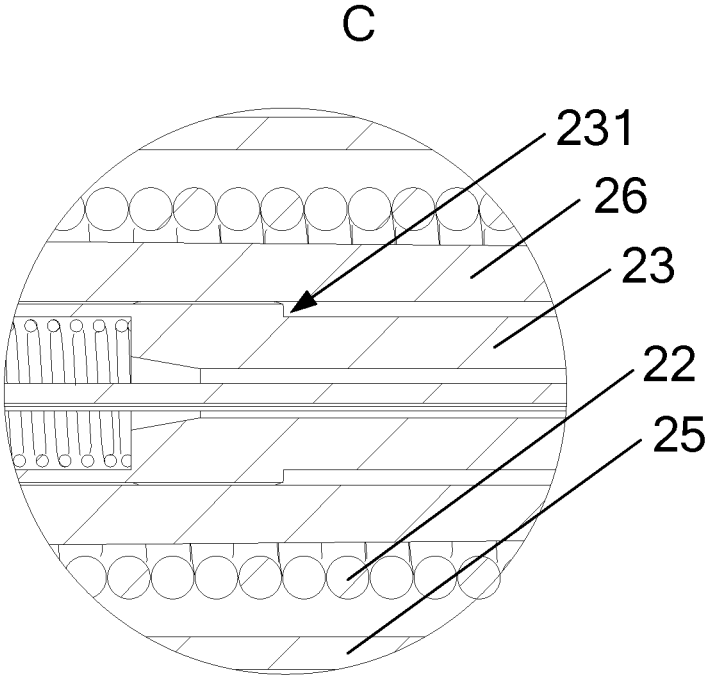
FIG. 4 is an enlarged view of a structure of portion C shown in FIG. 2 according to some exemplary embodiments.

In some exemplary embodiments, as shown in FIGS. 2 to 4, the clamping structure includes a fixing sleeve 26 and a fixing bushing 27. One end of the fixing sleeve 26 is connected with the first side of the moving piston 21, and the other end of the fixing sleeve 26 is further connected with the fixing bushing 27. The fixing bushing 27 is in cooperation with the limiting structure.

In some exemplary embodiments, the fixing sleeve 26 is sleeved outside the moving rod 23 and the moving rod compression spring 24, and the piston tension spring 22 is sleeved outside the fixing sleeve 26.

Figure 6:
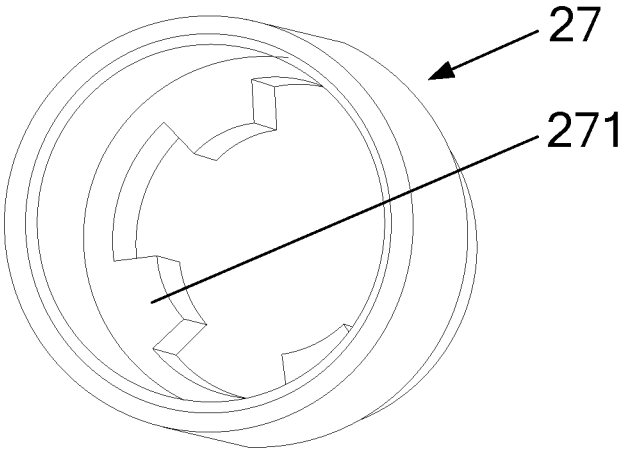
FIG. 6 is a schematic structural diagram of a fixing bushing according to some exemplary embodiments.

In some exemplary embodiments, both the fixing sleeve 26 and the fixing bushing 27 are sleeved outside the moving rod 23. The limiting structure is an annular step. The fixing bushing 27 is provided with a protrusion at a corresponding position, and the fixing bushing 27 drives the moving rod 23 to move by abutting the protrusion against the annular step. The structure of the fixing bushing is shown in FIG. 6.

In some exemplary embodiments, the moving piston 21 is connected with the fixing sleeve 26. The fixing sleeve 26 is arranged between the piston tension spring 22 and the moving rod compression spring 24. The fixing bushing 27 is provided at the end of the fixing sleeve 26. One end of the fixing bushing 27 away from the fixing sleeve 26 is provided with a plurality of radial protrusions. The limiting structure at a middle position of the moving rod 23 is provided as an annular step. When the fixing bushing 27 moves to the middle position of the moving rod 23, the radial protrusions abut against the annular step, thereby making the fixing bushing 27 drive the moving rod 23 to move together. After the moving piston 21 drives the fixing sleeve 26 and the fixing bushing 27 to move to the left for a distance S1, a conical surface of the fixing bushing 27 contacts a conical surface of the moving rod 23, so that the moving rod 23 moves to the left together with the moving piston 21. An end of the fixing bushing 27 close to an upper fixing head 4 is further provided with a chamfer (guide surface), which helps the fixing bushing to enter a groove portion of the upper fixing head 4.

Figure 5:
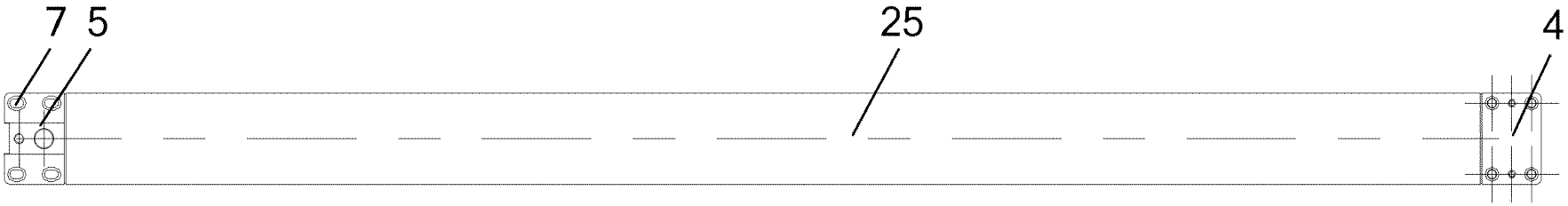
FIG. 5 is a schematic structural diagram of a balance cylinder according to some exemplary embodiments.

In some exemplary embodiments, as shown in FIG. 3 and FIG. 5, the upper fixing head 4 is mounted at one end of the cylinder body 25 provided with the moving rod 23, and the upper fixing head 4 is configured to close the one end of the cylinder body 25.

In some exemplary embodiments, as shown in FIG. 3 and FIG. 5, the other end of the cylinder body 25 away from the upper fixing head 4 is provided with a lower fixing head 5 configured to close the other end of the cylinder body 25.

In some exemplary embodiments, the upper fixing head 4 and the lower fixing head 5 are respectively configured to close two sides of the balance cylinder 2. Both the upper fixing head 4 and the lower fixing head 5 are provided with threaded holes 7. The balance cylinder 2 is mounted on the installation housing 1 by passing screws through the threaded holes 7, which is convenient for disassembly and maintenance.

In some exemplary embodiments, the lower fixing head 5 is provided with a through hole for introducing external mud into a cavity on the left side of the moving piston 21 in the balance cylinder 2.

In some exemplary embodiments, the other end of the balance cylinder 2 is provided with an oil and wire passing communication hole 8 for connecting with an oil tank and introducing hydraulic oil into a cavity on the right side of the moving piston 21.

In some exemplary embodiments, as shown in FIG. 2 and FIG. 3, the upper fixing head 4 is provided with a fixing end 31 of the displacement sensor 3. One end of the moving rod 23 close to the upper fixing head 4 is provided with a sliding end 32 of the displacement sensor 3.

In some exemplary embodiments, the fixing end 31 of the displacement sensor 3 is further connected with a fixing rod 33, the fixing rod 33 passes through the sliding end 32 of the displacement sensor 3, the moving rod 23 and the moving rod compression spring 24. The arrangement of the displacement sensor 3 enables the displacement sensor to measure the displacement of the moving rod 23, and further measure the displacement of the moving piston 21, so as to determine the oil level of the hydraulic oil in the instrument, thereby preventing occurrence of malignant accidents such as downhole mud invasion.

In some exemplary embodiments, a sealing plug 6 is installed on the other side of the moving piston 21, and the moving piston 21 and the sealing plug 6 divide the cylinder body 25 into two separate cavities. As shown in FIG. 2, when the sealing plug 6 is installed on the moving piston to divide the cylinder body 25 into two separate cavities, the piston tension spring 22, the moving rod 23, the moving rod compression spring 24 and the displacement sensor 3 and the like are all located in the cavity at the right. The sealing plug 6 may be configured in a sealing form of a large sealing plug combined with a small sealing plug.

In some exemplary embodiments, the device for detecting a downhole oil level is incorporated into a downhole instrument string, the lower portion thereof may be connected with a hydraumatic control pup joint, and the upper portion thereof may be connected with a control communication pup joint. Sealing rings are provided at the upper fixing head 4, the lower fixing head 5 and the sealing plug 6 to increase the sealing performance of the device. The upper fixing head 4 is further provided with the oil and wire passing communication hole 8 to ensure that oil may enter the cavity at the right from the oil tank and a wire of the displacement sensor 3 may be led out, etc. A mud scraping ring is further provided on a circumference of the left side of the moving piston 21 in contact with the cylinder body 25 to ensure that mud will not enter the cavity at the right through a joint between the moving piston 21 and the cylinder body 25 when the moving piston 21 moves to the left. The moving rod 23 moves inside the fixing bushing 27. Hydraulic oil may present at both sides of the fixing bushing 27. Moreover, since a contact area between the fixing bushing 27 and the moving rod 23 is relatively small, the movement resistance is smaller and the movement is flexible.

In some exemplary embodiments, the device for detecting a downhole oil level is convenient to maintain. When the balance cylinder 2 is maintained, there is almost no need to move the wire. With the fixing screws, the balance cylinder 2 may be directly detached from the installation housing 1 for separate maintenance, which is very convenient.

In some exemplary embodiments, when maintaining the balance cylinder 2 detached from the installation housing 1, the fixing end 31 of the displacement sensor 3 is fixed on the upper fixing head 4 of the balance cylinder 2. By first detaching a process plug on the upper fixing head 4, the fixing end 31 of the displacement sensor 3 can be quickly detached without detaching the moving piston 21 and the piston tension spring 22, thus avoiding a case in which it is required to detach the piston tension spring 22 and the moving piston 21 first, which may damage the fixing end 31 of the displacement sensor 3.

In some exemplary embodiments, the device for detecting a downhole oil level disclosed in the embodiments of the present application may determine a leakage speed of hydraulic oil according to a displacement speed of the moving piston 21. According to different moving speeds of the moving piston 21 at different positions, the leakage position is determined, thus the practicability of the device for detecting a downhole oil level is greatly improved.

The above embodiments are only used for illustrating the present application, but do not limit the protection scope of the present application. The protection scope of the present application is determined by the claims. According to the technology commonly-known in the art and the technical solutions disclosed in the present application, many variants may be deduced or conceived, and all these variants should also be construed as falling within the protection scope of the present application.

What we claim is:

1. A device for detecting a downhole oil level, comprising an installation housing and a balance cylinder installed on the installation housing;

wherein the balance cylinder comprises a cylinder body and a moving piston, a piston tension spring, a moving rod, a moving rod compression spring, a displacement sensor, a limiting structure and a clamping structure which are installed in the cylinder body;

one end of the piston tension spring is fixed at one end of the cylinder body, and the other end of the piston tension spring is connected with a first side of the moving piston, the first side of the moving piston is further connected with one end of the moving rod compression spring, the other end of the moving rod compression spring is connected with one end of the moving rod, and the other end of the moving rod is provided with the displacement sensor, the displacement sensor is configured to measure a displacement of the moving piston; and the other end of the moving rod is provided with the limiting structure, the first side of the moving piston is connected with the clamping structure, and the moving piston is configured to drive the moving rod to move through a cooperation between the clamping structure, the limiting structure and the moving rod compression spring.

2. The device for detecting a downhole oil level according to claim 1, wherein the clamping structure comprises a fixing sleeve and a fixing bushing, one end of the fixing sleeve is connected with the first side of the moving piston, and the other end of the fixing sleeve is further connected with the fixing bushing, and the fixing bushing is configured to cooperate with the limiting structure.

3. The device for detecting a downhole oil level according to claim 2, wherein the fixing sleeve and the fixing bushing are both sleeved outside the moving rod, the limiting structure is an annular step, the fixing bushing is provided with a radial protrusion, and the fixing bushing is configured to drive the moving rod to move by abutting the protrusion against the annular step.

4. The device for detecting a downhole oil level according to claim 3, wherein the fixing sleeve is sleeved outside the moving rod and the moving rod compression spring, and the piston tension spring is sleeved outside the fixing sleeve.

5. The device for detecting a downhole oil level according to claim 4, wherein the balance cylinder further comprises a sealing plug, the sealing plug is installed on a second side of the moving piston, and an inner space of the cylinder body is divided into two separate cavities by the moving piston and the sealing plug.

6. The device for detecting a downhole oil level according to claim 3, wherein the balance cylinder further comprises a sealing plug, the sealing plug is installed on a second side of the moving piston, and an inner space of the cylinder body is divided into two separate cavities by the moving piston and the sealing plug.

7. The device for detecting a downhole oil level according to claim 2, wherein the balance cylinder further comprises a sealing plug, the sealing plug is installed on a second side of the moving piston, and an inner space of the cylinder body is divided into two separate cavities by the moving piston and the sealing plug.

8. The device for detecting a downhole oil level according to claim 1, wherein the balance cylinder further comprises an upper fixing head; the upper fixing head is mounted at one end of the cylinder body provided with the moving rod, and the upper fixing head is configured to close the one end of the cylinder body.

9. The device for detecting a downhole oil level according to claim 8, wherein the displacement sensor comprises a fixing end and a sliding end, the upper fixing head is provided with the fixing end of the displacement sensor, and one end of the moving rod close to the upper fixing head is provided with the sliding end of the displacement sensor.

10. The device for detecting a downhole oil level according to claim 9, wherein the displacement sensor further comprises a fixing rod connected with the fixing end, and the fixing rod is configured to pass through the sliding end of the displacement sensor, the moving rod and the moving rod compression spring.

11. The device for detecting a downhole oil level according to claim 10, wherein the balance cylinder further comprises a sealing plug, the sealing plug is installed on a second side of the moving piston, and an inner space of the cylinder body is divided into two separate cavities by the moving piston and the sealing plug.

12. The device for detecting a downhole oil level according to claim 9, wherein the balance cylinder further comprises a sealing plug, the sealing plug is installed on a second side of the moving piston, and an inner space of the cylinder body is divided into two separate cavities by the moving piston and the sealing plug.

13. The device for detecting a downhole oil level according to claim 8, wherein the balance cylinder further comprises a sealing plug, the sealing plug is installed on a second side of the moving piston, and an inner space of the cylinder body is divided into two separate cavities by the moving piston and the sealing plug.

14. The device for detecting a downhole oil level according to claim 8, wherein the balance cylinder further comprises a lower fixing head, the other end of the cylinder body away from the upper fixing head is provided with the lower fixing head, and the lower fixing head is configured to close the other end of the cylinder body.

15. The device for detecting a downhole oil level according to claim 14, further comprising screws, wherein the upper fixing head and the lower fixing head are both provided with threaded holes, and the screws are configured to pass through the threaded holes to install the balance cylinder on the installation housing.

16. The device for detecting a downhole oil level according to claim 1, wherein the balance cylinder further comprises a sealing plug, the sealing plug is installed on a second side of the moving piston, and an inner space of the cylinder body is divided into two separate cavities by the moving piston and the sealing plug.

* * * * *